United States Patent [19]

Melotti

[11] 4,367,608

[45] Jan. 11, 1983

[54] BUBBLES EMITTING TOY VEHICLE

[76] Inventor: Athos Melotti, Via dello Spalto, 3, Bologna, Italy

[21] Appl. No.: 278,221

[22] Filed: Jun. 29, 1981

[30] Foreign Application Priority Data

Jul. 24, 1980 [IT] Italy ..... 4913/80[U]

[51] Int. Cl.[3] ..... A63H 33/28

[52] U.S. Cl. ..... 46/7; 46/202

[58] Field of Search ..... 46/7, 8, 6, 202

[56] References Cited

U.S. PATENT DOCUMENTS 2,579,714 12/1951 Treuthart ..... 46/8

3,388,498 6/1968 Greene ..... 46/8

3,775,899 12/1973 Wolf ..... 46/7

4,016,673 4/1977 Constance ..... 46/8 X

*Primary Examiner*—Mickey Yu

*Attorney, Agent, or Firm*—Guido Modiano; Albert Josif

[57] ABSTRACT

A toy vehicle emitting bubbles of the type of soap bubbles having a wheeled frame whereon a puppet is effective to slide in a vertical direction being urged to a raised position by a spring: on the frame is further supported a blowring adapted to be dipped, with the puppet in the raised position thereof, into a reservoir containing a bubble forming liquid, a hose being provided for blowing air through the blowring with the puppet depressed against the bias of the spring.

2 Claims, 2 Drawing Figures

1
2
3
4
6
7
8
9
10
11
12
15
16
17
18
19
20
21
22
23
25
28
30
32a
32b
33
34
35
36
37
38
39
41
42
43
44
45
46
47
48
49
50
51
52
53
54
55
56
57
58
59
60
61
62
63
64
65
66
67
68

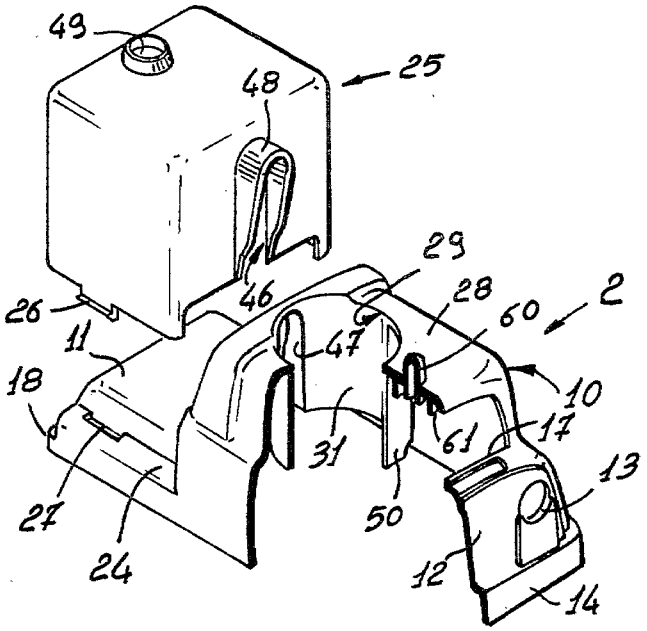
Fig. 2
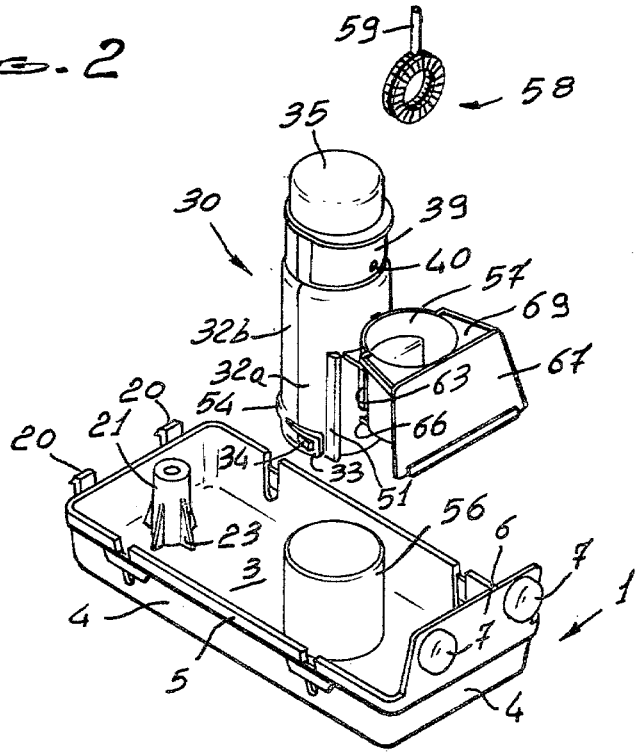

BUBBLES EMITTING TOY VEHICLE

BACKGROUND OF THE INVENTION

This invention relates to a toy vehicle emitting bubbles of the type of soap bubbles.

Playing with soap bubbles is still a widespread form of entertainment, and to produce such bubbles, blowrings are usually employed which, when dipped in a specially formulated liquid, are apt to withhold an amount of that liquid, thereby by blowing through the ring one or more bubbles can be emitted.

Such bubble blowrings are, however, only partly successful in meeting the playing and amusement preferences of children—for whom they are particularly intended—and there exists a demand for association of said bubble emission with new forms of play.

SUMMARY OF THE INVENTION

It is a primary object of this invention to provide a toy vehicle whereby bubbles of the type of soap bubbles can be produced.

A further object of this invention is to provide a toy vehicle which is simple in design, easy to use, and of relatively low cost.

These objects are achieved, according to the invention, by a toy vehicle emitting bubbles of the type of soap bubbles, characterized in that it comprises a wheel-mounted frame, a puppet guided for sliding movement in a vertical direction on said frame and urged to a raised position by a spring means, a blowring carried on said frame and adapted to be dipped, with said puppet in said raised position, into a reservoir containing a liquid for forming bubbles of the type of soap bubbles, said reservoir engaging said puppet, and a means for blowing air through said ring, with said puppet lowered or depressed againt the bias of said spring means.

BRIEF DESCRIPTION OF THE DRAWINGS

Further features of the invention will be more clearly apparent from the following detailed description of a preferred embodiment of this bubble emitting toy vehicle, as illustrated by way of example in the accompanying drawings, where:

FIG. 2 is an exploded, partly cut away, perspective view thereof.

DESCRIPTION OF THE PREFERRED EMBODIMENTS

Figure 1:
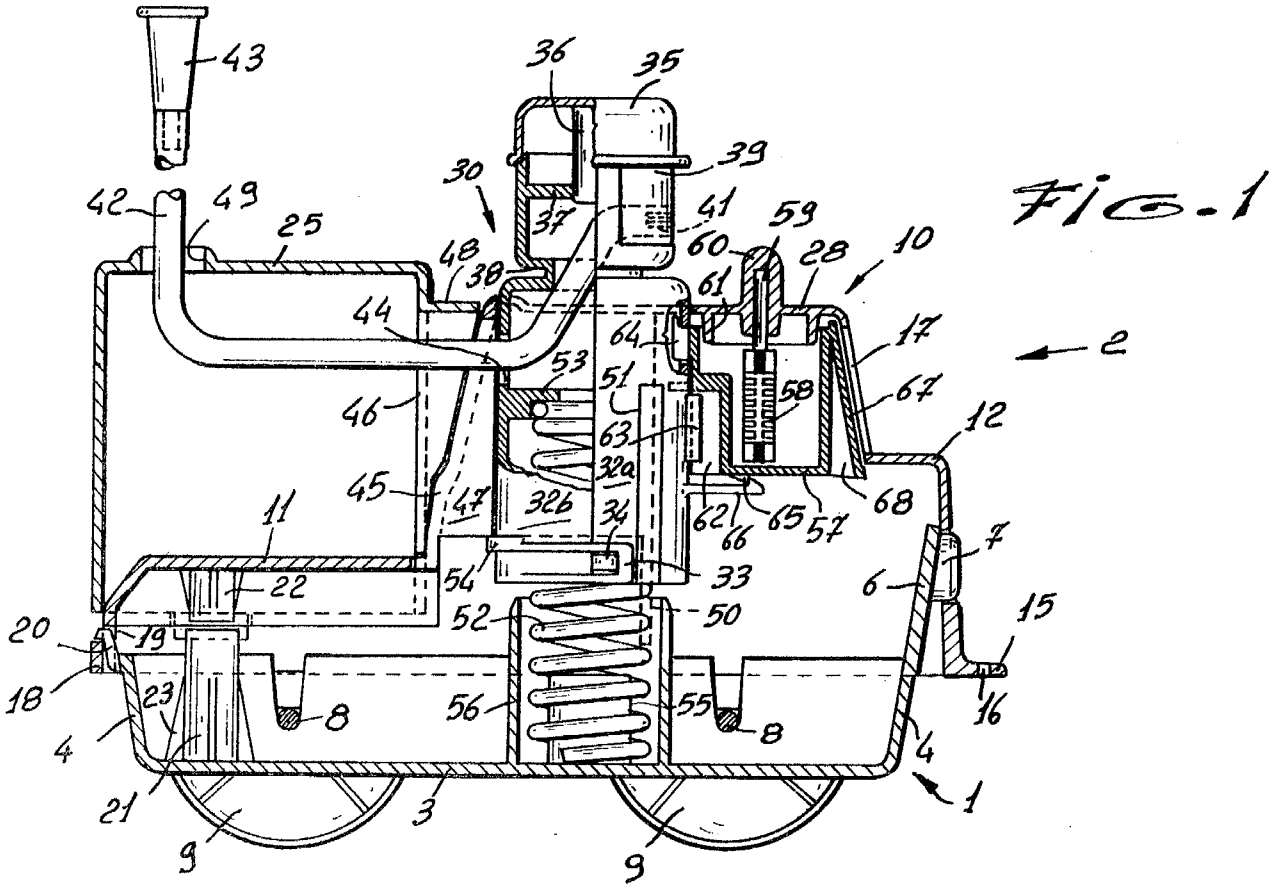
FIG. 1 is a longitudinal, vertical section view of a toy vehicle according to the invention.

With reference to the drawing figures, the toy vehicle of this invention comprises a frame which configures a truck of some sort. Said frame includes a base 1 and body 2 mounted on said base.

The base 1 of the frame comprises, in turn, a reservoir having a rectangular bottom 3 and side members 4 which slope slightly outwards. The side members 4 are terminated with a thickened rim 5 which forms a support for the overlying body 2.

The front side member of the base 1 is extended upwardly, to a level above the thickened rim 5, into a small wall which configures a pair of frontally located headlights 7.

Through the lateral side members are instead passed axles 8 for two pairs of wheels 9 which enable the toy vehicle to travel on the ground. The upper body 2 of the frame configures a downward facing concavity, and when applied on the base 1, will cover the side members 4 along the edges thereof. The body 2 defines substantially a forward cab 10 and rear flat platform 11.

Forward of the cab 10, there extends an engine hood 12, wherethrough holes 13 are formed which accommodate respectively the two headlights 7 of the base 1. At the bottom of the hood 12, a bumper 14 is provided; from that bumper, there extends a centrally located lug 15, for towing the toy with a string or the like. Above the hood 12, the cab is provided with a windshield window 17.

A bumper 18 is also defined on the rear of the platform 11; at this bumper, slots 19 are formed wherethrough a pair of latches 20 are inserted elastically which protrude from the edge of the rear side member of the base 1 to create a connection for the two parts of the vehicle frame. The base 1 and body 2 are then rigidly secured to each other by means of a screw, not shown in the drawing, which engages threadably corresponding seats in two coaxial tubes 21 and 22 extending vertically upwards, one from the bottom 3 of the base 1, and the other from the platform 11 of the body 2, on the side of the respective concavity. The tubes 21, 22 are suitably strengthened by outside ribs 23.

The platform 11 has step-like recessed longitudinal edges 24, whereon a bin or truck body 25 of parallelepipedal shape is arranged to bear which is hollow and open at the bottom, said bin being fastened to the platform by means of further latches 26 which penetrate elastically corresponding slots 27 formed in the longitudinal edge portions 24 of the platform.

The cab 10 has a roof 28 formed with a large circular hole 29. Through the hole 29, there is passed for sliding movement in a vertical direction, a puppet 30 of substantially tubular cylinder configuration. The puppet 30 is guided within a sleeve 31 extending under the roof 28 of the cab 10, from the rim of the hole 29.

The puppet 30 is made in two hemicylindrical halves, indicated at **32*a* and 32*b*, which are locked in place at the bottom by means of a pair of side eyes 33 in the rear half 32*b* elastically engaging matching teeth 34 on the front half 32*a***.

At their top ends, the two halves **32*a*, 32*b* of the puppet are covered by a cap 35. The cap has a pin 36, located centrally on the inside thereof, which can be inserted through a hole in a diaphragm 37 formed internally to the puppet. That portion of the puppet which extends under the cap 35, which portion defines the head of the puppet, has a reduced diameter with respect to the lower portion which is separated therefrom by a groove 38. At the puppet head, the front half 32*a* has an outside depressed area which forms a seat 39 for the application of a figure representing the puppet face. Level with the mouth of said puppet face, there is formed a small hole 40 which is connected, through a fitting formed inside the puppet and shown in dotted lines as 41 in FIG. 1, to a small hose 42; said hose having at its free end a small blowpipe 43** for blowing air therethrough.

The hose 42 projects out of the puppet 30 through a hole 44 formed in the rear half **32*b* of the puppet, and is then inserted into the bin 25 through vertical apertures 45 and 46 respectively formed opposite each other in the rear wall of the cab 10 and in front wall of the bin. The aperture 45 of the cab 10 is connected to a longitudinal rear cutout in the sleeve 31 by side walls 47. The aperture 46 of the bin 25 is outlined externally by an arch 48 which has decreasing depth, from top to bottom, on its vertical sides to match the slope of the rear wall of the cab 10. The hose 42 comes out of the bin 25 through an upper hole 49 in the latter. The sleeve 31 also has a front longitudinal cutout from the edges whereof there extend a pair of vertical walls 50 laid transversely to the vehicle longitudinal axis. Said edges are contacted, in sliding relationship, by respective guides 51 applied longitudinally to the outer surface of the puppet front half 32***a*.

The puppet 30 is urged upwardly by a coil spring 52 which abuts, at one end, against the bottom 3 of the base 1, and at the other end, against a shoulder 53 formed inside the puppet. The raised position of the puppet is defined by an outer boss 54 on the rear half 32*b* engaging with the bottom or lower edge of the sleeve 31.

The spring 52 is guided on a small cylinder 55 formed in the bottom 3 of the base 1, and is inserted partly within a cylindrical coaxial tube 56. The cylinder 56 acts as an internal guide for the puppet 30 in the downward sliding movement thereof. The puppet 30 has, attached to the front thereof, a small reservoir 57 intended for containing the bubble forming liquid. Into the reservoir 57, with the puppet 30 in its raised position, there can be dipped a blowring 58 mounted by means of a stem 59 on a seat 60 formed in the roof 28 of the cab 10. The blowring 58 is of the type including a set of vanes defining a respective series of capillary channels effective to retain some of the bubble forming liquid therein.

The seat 60 is encircled by an annular ring 61 against which the reservoir 57 is adapted to be sealed.

The reservoir 57 has on the rear a flange 62 which is mounted between a pair of longitudinal puppet guides 63, and a hook 64 which is inserted through a slot in the puppet. At the bottom, the reservoir 57 is engaged, through a detent tooth or pawl 65, with a toothed lug 66 which extends forward of the puppet.

Forward of the reservoir 57, there is a plate 67 adapted to form the windshield for the window 17 of the cab 10, it being laid to abut the latter from within the body 2 of the frame. The plate 67 is connected rigidly to the reservoir by a vertical rib 68, extending in the centerplane of the vehicle, and a pair of horizontal ribs 69, which extend symmetrically from the top edge of the reservoir.

The operation of this bubble emitting toy vehicle will be readily understood in the light of the foregoing description. In the rest condition, the puppet 30, owing to the action of the spring 52, is in the raised position, and the blowring 58 is dipped into the reservoir 57 which had been previously filled with the special bubble forming liquid. In that same position, the plate 67 will close the window 17 of the cab 10 windshield-fashion.

As the puppet 30, which protrudes out of the roof 28 of the cab 10, is pushed downwards against the bias of the spring 52, bubble forming liquid is withheld by capillary action on the machined surfaces of the blowring 58. In the lowered or depressed position, the hole 40 of the puppet is aligned axially with the blowring, the latter facing the window 17 which is by now no longer covered by the plate 67.

Then, by blowing air through the hose 42, long trains of bubbles are emitted out of the vehicle windshield window. It should be noted that the hose 42 is normally coiled inside the bin 25, and the pipe 43 is inserted through the hole 49; when air is blown in, by pulling the blowpipe, part of the hose is drawn out of the bin, as shown in FIG. 1.

Thus, the toy vehicle according to the invention achieves the object of providing novel forms of entertainment in the blowing of bubbles of the type of soap bubbles.

Obviously, the outward appearance of the vehicle may differ from the one described hereinabove.

In practicing the invention, the materials used, as well as shapes and dimensions, may be any ones to suit individual requirements.

Moreover, all of the details may be replaced with other technically equivalent ones.

I claim:

1. A toy vehicle emitting bubbles of the type of soap bubbles, comprising a wheel-mounted frame, an opening formed in said frame, a blowring carried inside said frame and facing said opening, a puppet guided for sliding movement in a vertical direction in said frame, a hole formed in said puppet and connected with air blowing means, spring means urging said puppet in a raised position, a reservoir containing a liquid for forming bubbles fixed onto said puppet and engaged by said blowring when the puppet is in said raised position, said air blowing means being effective when the puppet is depressed in a lowered position against the bias of said spring means and the blowring is aligned with said hole, and a plate rigid with said puppet for covering said opening, said opening configuring a front window of the vehicle and said plate forming the windshield of said window.

2. A toy vehicle as claimed in claim 1, wherein said air blowing means comprise a hose connected with one end to a fitting formed inside said puppet at said hole and coming with the other end out of the vehicle frame, said hose being adapted to be coiled inside a bin member integral with said frame.

* * * * *